US012653289B2

(12) United States Patent
Ortiz

(10) Patent No.: US 12,653,289 B2
(45) Date of Patent: Jun. 16, 2026

(54) HAIR ACCESSORY FOR USE WITH HAIR ORNAMENTS

(71) Applicant: Journey Well, L.L.C., Las Vegas, NV (US)

(72) Inventor: Lionel K. Ortiz, Las Vegas, NV (US)

(73) Assignee: Journey Well, L.L.C., Las Vegas, NV (US)

( * ) Notice: Subject to any disclaimer, the term of this patent is extended or adjusted under 35 U.S.C. 154(b) by 0 days.

(21) Appl. No.: 19/087,704

(22) Filed: Mar. 24, 2025

(65) Prior Publication Data

US 2025/0311826 A1 Oct. 9, 2025

Related U.S. Application Data

(60) Provisional application No. 63/575,834, filed on Apr. 7, 2024.

(51) Int. Cl.
*A45D 8/30* (2006.01)
*A45D 8/00* (2006.01)

(52) U.S. Cl.
CPC ..... *A45D 8/30* (2013.01); *A45D 8/006* (2021.01)

(58) Field of Classification Search
CPC . A45D 2/08; A45D 2/10; A45D 2/122; A45D 2/125; A45D 2/14; A45D 2/141; A45D 2/143; A45D 2/145; A45D 2/146; A45D 2/148; A45D 2/16; A45D 2/24; A45D 2/2407; A45D 2/2414; A45D 2/2421; A45D 2/2457; A45D 2/2471; A45D 2/2485; A45D 2/2492; A45D 2/42; A45D 2/44; A45D 6/145; A45D 8/00;
(Continued)

(56) References Cited

U.S. PATENT DOCUMENTS 904,566 A * 11/1908 Schwab ..... A45D 2/42 63/3
2,384,013 A * 9/1945 Caldora ..... A45D 24/02 132/148

(Continued)

FOREIGN PATENT DOCUMENTS

NL 1039537 C2 10/2013

OTHER PUBLICATIONS

Amazon, "Arial Pack of 40 Interchangable Elastic Headbands Baby Girl Headbands 20 Colors DIY Accessories for Flow or Bows Headband," pp. 1-7, 2020, https://www.amazon.com/Arlai-Interchangeable-Elastic-Headbands-Colors/dp/B01JC5VL4W.

(Continued)

*Primary Examiner* — Rachel R Steitz
*Assistant Examiner* — Karim Asqiriba
(74) *Attorney, Agent, or Firm* — The Powers IP Law Firm

(57) ABSTRACT

A hair accessory is for use with a plurality of hair ornaments. The hair accessory includes a gripping member and an elastic member. The gripping member grips hair of a user, and has a body and a plurality of gripping protrusions. The body has a first side, a second side, and a plurality of through holes extending from the first side to the second side. The elastic member is woven among the through holes and is configured such that a plurality of associated elastic segments are located on each of the first and second sides of the body, thereby allowing the plurality of hair ornaments to be maintained on the first side of the body.

16 Claims, 7 Drawing Sheets

(58) Field of Classification Search
CPC ... A45D 8/02; A45D 8/06; A45D 8/10; A45D 8/12; A45D 8/14; A45D 8/16; A45D 8/20; A45D 8/22; A45D 8/24; A45D 8/26; A45D 8/28; A45D 8/30; A45D 8/32
See application file for complete search history.

(56) References Cited

U.S. PATENT DOCUMENTS

| | | | | |
|---|---|---|---|---|
| 5,379,783 | A * | 1/1995 | Healzer | A45D 8/24 132/278 |
| 5,398,705 | A * | 3/1995 | Hiltbrand | A45D 8/24 132/273 |
| 5,441,061 | A * | 8/1995 | Jordan | A45D 8/20 132/277 |
| 5,682,908 | A * | 11/1997 | Chou | A45D 8/12 132/278 |
| 5,697,387 | A | 12/1997 | Hanisco | |
| 6,237,611 | B1 | 5/2001 | LeCrone et al. | |
| 6,289,903 | B1 * | 9/2001 | Haufler | A01K 27/006 63/23 |
| 7,013,900 | B2 * | 3/2006 | Silva | A45D 8/12 132/273 |
| 7,040,326 | B1 * | 5/2006 | Painter | A45D 2/20 132/248 |
| 8,678,017 | B2 * | 3/2014 | Arpey | A45D 8/12 132/144 |
| 10,258,133 | B2 | 4/2019 | Beck et al. | |
| 10,441,047 | B2 | 10/2019 | Egner | |
| 10,945,474 | B2 | 3/2021 | Atkinson-Skinner | |
| 2002/0007838 | A1 | 1/2002 | Wochadlo | |
| 2003/0015213 | A1 * | 1/2003 | Sartena | A45D 8/24 132/275 |
| 2004/0237992 | A1 | 12/2004 | Klug | |
| 2007/0023061 | A1 | 2/2007 | Dorazio | |
| 2008/0216862 | A1 * | 9/2008 | Silva | A45D 8/20 132/277 |
| 2008/0251095 | A1 * | 10/2008 | Pommer | A45D 2/125 132/249 |
| 2009/0266375 | A1 | 10/2009 | Patredis | |
| 2011/0000499 | A1 * | 1/2011 | Hsu | A45D 8/12 132/273 |
| 2011/0011763 | A1 | 1/2011 | Doyle | |
| 2011/0120493 | A1 | 5/2011 | Wills | |
| 2011/0297179 | A1 * | 12/2011 | Tu | A45D 8/36 132/278 |
| 2012/0125360 | A1 | 5/2012 | Hill et al. | |
| 2012/0137474 | A1 | 6/2012 | Erikson | |
| 2012/0167909 | A1 * | 7/2012 | Stewart | A45D 8/12 132/145 |
| 2012/0180805 | A1 * | 7/2012 | Conway | A45D 8/06 132/200 |
| 2013/0108884 | A1 | 5/2013 | Lillich | |
| 2014/0290680 | A1 * | 10/2014 | Webster | A45D 24/10 132/129 |
| 2014/0338694 | A1 | 11/2014 | Van Dyne | |
| 2017/0006990 | A1 | 1/2017 | Tiernan et al. | |
| 2019/0133287 | A1 * | 5/2019 | Adams | A45D 8/02 |
| 2020/0008550 | A1 * | 1/2020 | Mackenzie | A45D 8/34 |
| 2023/0263283 | A1 * | 8/2023 | Burgio | A45D 8/30 132/132 |
| 2024/0197053 | A1 | 6/2024 | Mizuno | |

OTHER PUBLICATIONS

Ebay, "Double Comb Hair Clip Elegant Adjustable High Ponytail Elastic Rope Comb Hairpin," pp. 1-5, 2021, https://www.ebay.com/itm/286056176531.

* cited by examiner

HAIR ACCESSORY FOR USE WITH HAIR ORNAMENTS

CROSS REFERENCE TO RELATED APPLICATION

This application claims priority to and claims the benefit of U.S. Provisional Patent Application Ser. No. 63/575,834, filed Apr. 7, 2024, and entitled "Custom and Reusable Hair Accessory for Floral and Ornament Arrangement", the contents of which are incorporated herein by reference in their entirety.

BACKGROUND

When adorning hair with fresh or imitation flowers, or other ornaments, these items are generally secured to the hair with a hairpin, such as a bobby pin. Using hairpins can be difficult because one or more hairpins are needed to hold each flower or ornament. It is further difficult because users often pin flowers out of direct sight (e.g., they cannot see what they are doing), such as to the side of the head or behind the head.

Other hair accessories that allow for using flowers or other ornaments to create a customizable hair accessory often include permanent methods such as glue, which does not allow the hair apparatus to be re-used for another customizable hair accessory. Others may use adhesives, hook-and-loop, snap-on, or other securing mechanisms, including ties, or ornaments provided for a specific hair accessory. In each of these cases, the securing of flowers/ornaments to the head of a user is performed in a less-than-ideal manner.

It is with respect to these and other considerations that the instant disclosure is concerned.

The above information disclosed in this Background section is only for understanding of the background of the inventive concepts, and, therefore, it may contain information that does not constitute prior art.

SUMMARY

In one aspect of the disclosed concept, a hair accessory is provided for use with a plurality of hair ornaments. The hair accessory comprises a gripping member configured to grip hair of a user, the gripping member comprising a body and a plurality of gripping protrusions each extending outwardly from the body in order to grip the hair of the user, the body having a first side, a second side opposite the first side, and a plurality of through holes extending from the first side to the second side; and an elastic member woven among the plurality of through holes and configured such that a plurality of associated elastic segments are disposed on each of the first and second sides of the body, thereby allowing the plurality of hair ornaments to be maintained on the first side of the body by the plurality of elastic segments disposed on the first side of the body.

In another aspect, the hair accessory further includes a cover coupled to the second side of the body and configured to cover the plurality of elastic segments disposed on the second side of the body. The cover preferably has a plurality of through holes in order to provide a drainage mechanism for the plurality of hair ornaments maintained on the first side of the body. Furthermore, there may be a first plurality of gripping protrusions and a second plurality of gripping protrusions, and the cover may be located therebetween. Moreover, the gripping member may be a first gripping member, the hair accessory may further include a second gripping member coupled to the first gripping member and configured to grip the hair of the user, and the first and second gripping members may open and close with respect to each other in order to allow at least some of the hair of the user to be gripped therebetween.

In yet a further example of the disclosed concept, another hair accessory for use with a plurality of hair ornaments is provided. The hair accessory comprises a gripping member configured to maintain hair of a user, the gripping member comprising a body having a first side, a second side opposite the first side, and a plurality of through holes extending from the first side to the second side; and an elastic member woven among the plurality of through holes and configured such that a plurality of associated elastic segments are disposed on each of the first and second sides of the body, thereby allowing the plurality of hair ornaments to be maintained on the first side of the body by the plurality of elastic segments disposed on the first side of the body.

BRIEF DESCRIPTION OF THE DRAWINGS

Non-limiting and non-exhaustive embodiments of the present invention are described with reference to the following figures. Other advantages of the present disclosure will be readily appreciated, as the same becomes better understood by reference to the following detailed description when considered in connection with the accompanying drawings wherein.

DETAILED DESCRIPTION

As employed herein, the term "coupled" shall mean connected together either directly or via one or more intermediate parts or components.

As employed herein, the term "number" shall mean one or an integer greater than one (i.e., a plurality).

As employed herein, the phrase "non-linear manner" shall mean a weave pattern wherein individual segments of a member are not woven along a linear or curvilinear axis located in a plane, whereas "linear manner" shall mean a weave pattern wherein individual segments of a member are woven along a linear or curvilinear axis located in a plane.

Figure 1A:
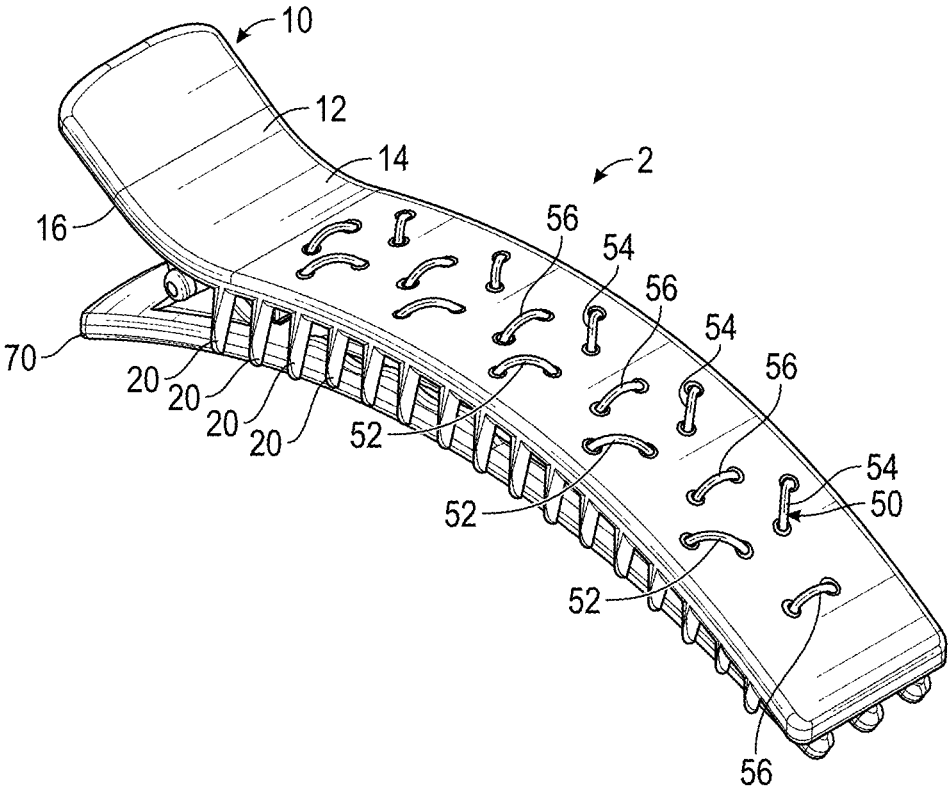
FIG. 1A is an isometric view of a hair accessory, in accordance with one non-limiting embodiment of the disclosed concept.
Figure 1B:
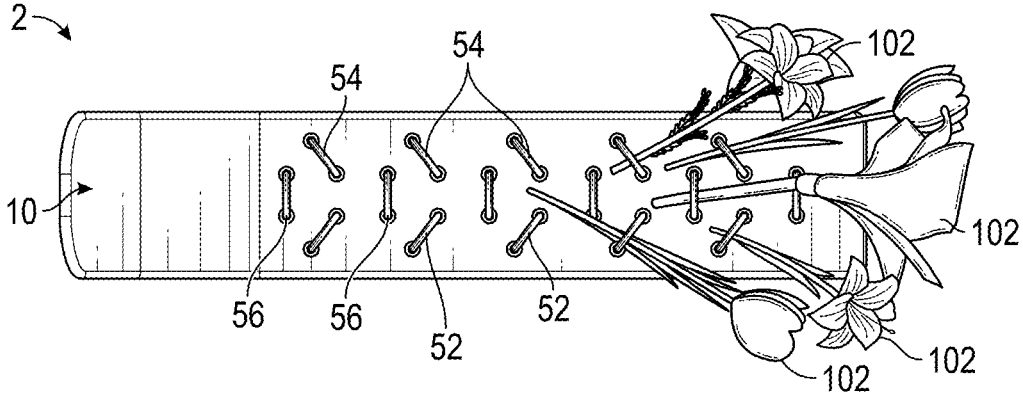
FIG. 1B is a top view of the hair accessory of FIG. 1A, shown as employed with a plurality of hair ornaments secured to the hair accessory.
Figure 1C:
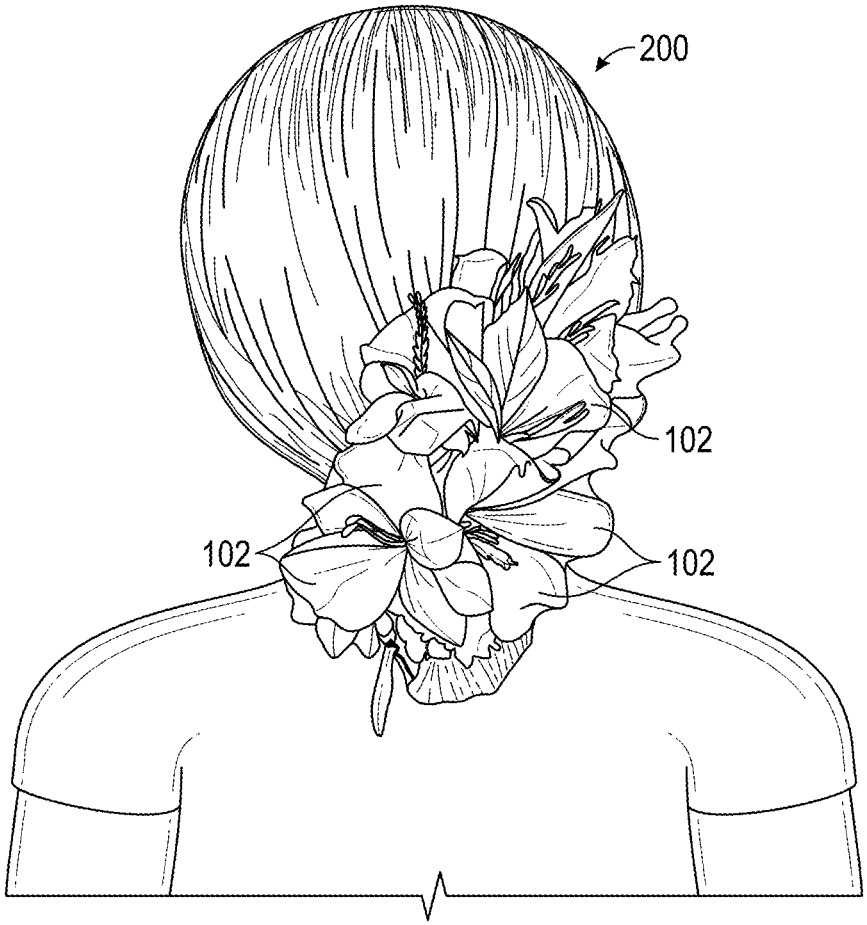
FIG. 1C is a view of the back of a head of a user who is wearing the hair accessory of FIGS. 1A and 1B, and with a plurality of hair ornaments secured to the hair accessory.
Figure 2:
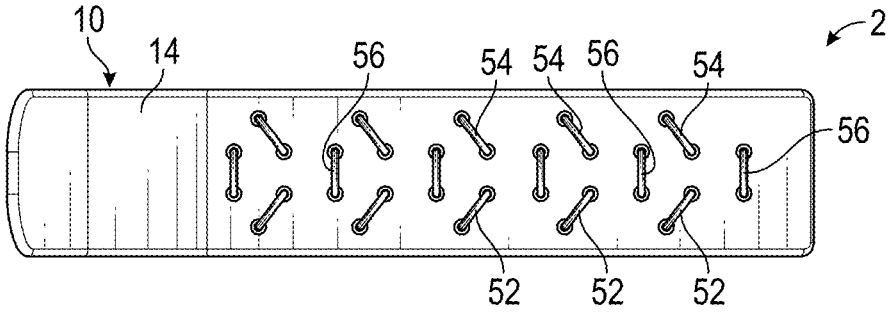
FIGS. 2-4 are top, side, and bottom views of the hair accessory of FIGS. 1A and 1B.
Figure 3:
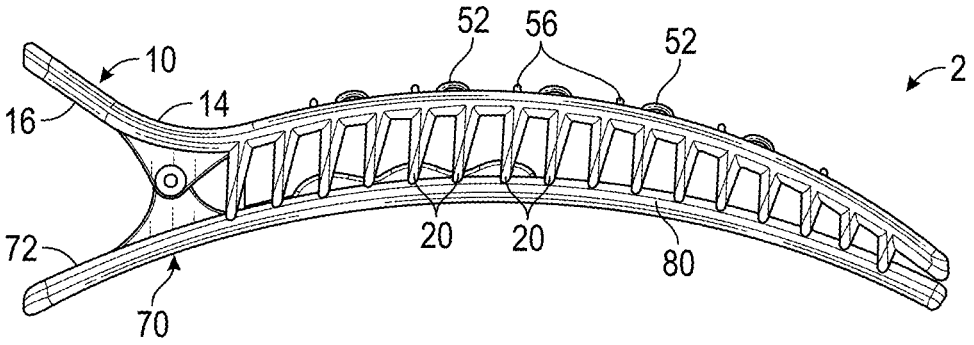
Figure 4:
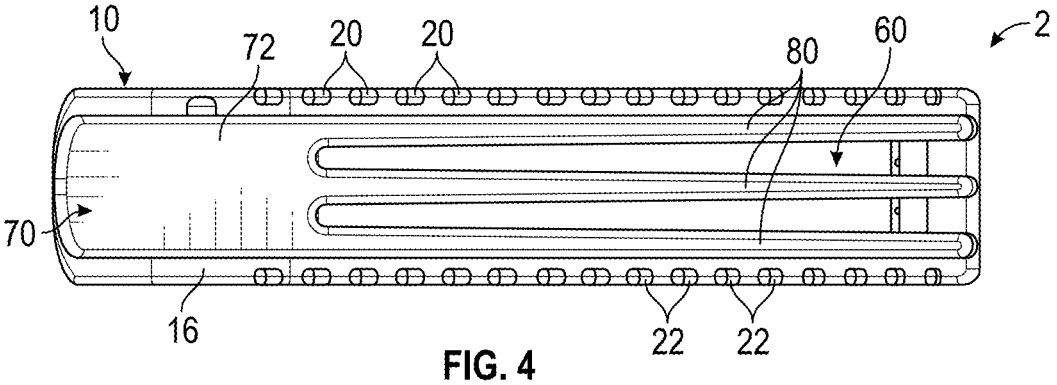

FIGS. 1A, 1B, and 2-5 show various views of a hair accessory 2, and FIG. 1C shows the back of the head of a user 200 wearing the hair accessory 2, in accordance with one non-limiting embodiment of the disclosed concept. As will be discussed in greater detail below, the hair accessory 2 advantageously allows a number of hair ornaments (e.g., without limitation, fresh and/or imitation flowers 102) to be worn by the user 200 (FIG. 1C). This is beneficial as compared to known art, in which ornaments may only be maintained on the head of a user by hairpins. With the hair accessory 2, by way of contrast, one single device allows a large number of the flowers 102 to be maintained on the head of the user 200 (FIG. 1C) in a simple and reliable manner.

Figure 5:
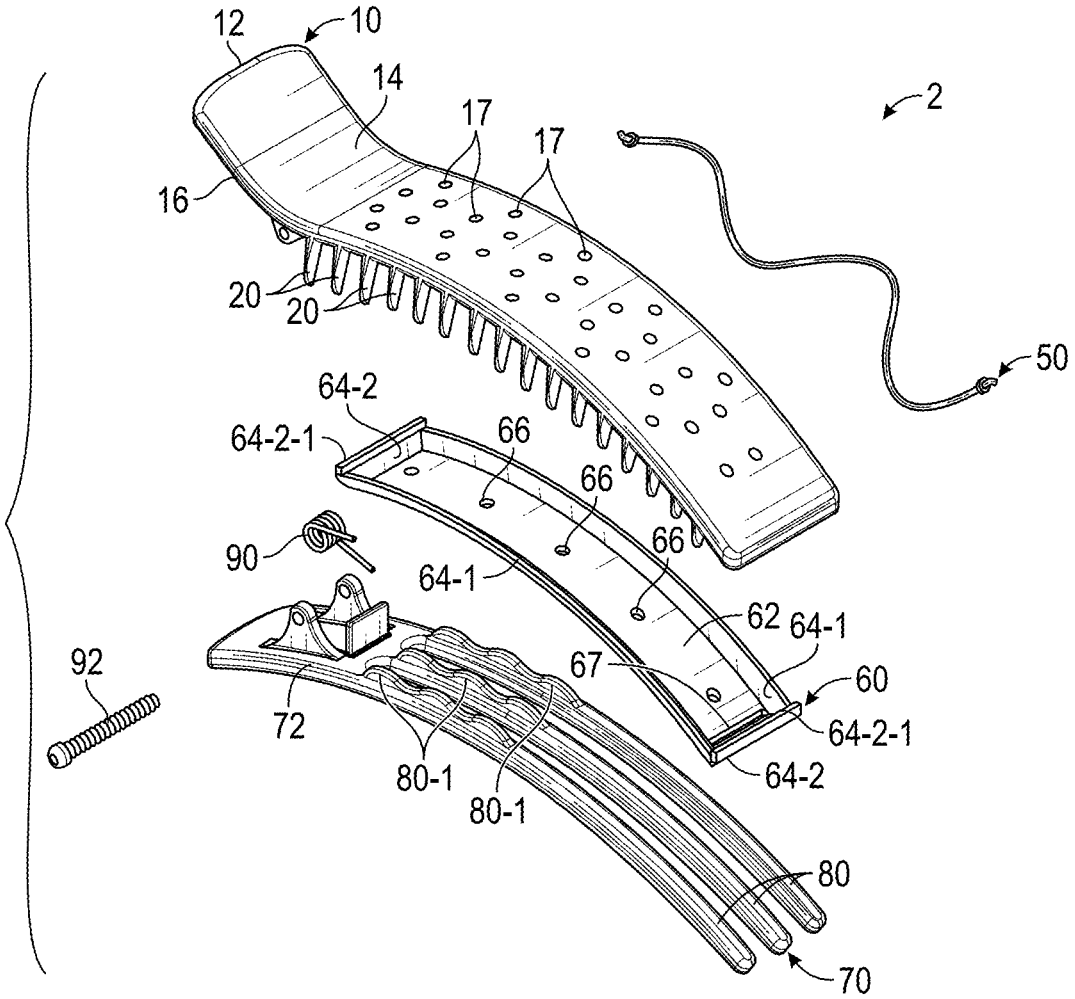
FIG. 5 is an exploded isometric view of the hair accessory of FIGS. 2-4.

In order to achieve these benefits, the hair accessory 2 includes two main gripping members 10,70 that together grip the hair of the user 200 (FIG. 1C). In one example, each of the gripping members 10,70 are unitary components made from single pieces of material (e.g., injection molded pieces and/or hand-crafted pieces from single pieces of material). Furthermore, as shown in FIG. 5, the hair accessory 2 further includes a biasing member (e.g., spring 90) and a coupling member 92 (e.g., a bolt, screw, or other fastener) configured to extend through the spring 90 and mounting structures of each of the first and second gripping members 10,70. The spring 90 is coupled to and preferably engages each of the first and second gripping members 10,70 in order to allow the first and second gripping members 10,70 to be biased toward a closed position. In other words, the spring 90 keeps the hair accessory 2 closed. However, when the user 200 applies a force to the gripping members 10,70 and causes them to be opened (e.g., squeezes end portions of the gripping members 10,70 toward one another), the gripping members 10,70 are configured to reliably open and grip the hair of the user 200 therebetween.

More specifically, the gripping members 10,70 each include bodies 12,72 and pluralities of gripping protrusions 20,22,80 extending outwardly from the bodies 12,72. The gripping protrusions 20,22,80 are preferably spaced from one another, and are configured to extend into and grip the hair of the user 200 (FIG. 1C). Furthermore, as shown most clearly in FIG. 4, the gripping protrusions 80 of the second gripping member 70 extend transverse (e.g., are oriented perpendicular) with respect to the gripping protrusions 20,22 of the first gripping member 10 in order that the hair of the user 200 can be gripped in two different orientations. Moreover, the elongated gripping protrusions 80 preferably also each have a number of additional gripping protrusions 80-1 extending from the second gripping member 70 toward the first gripping member 10, and each configured to apply additional gripping forces to the hair of the user 200 (FIG. 1C) opposite the forces applied by the gripping protrusions 20,22.

Figure 6A:
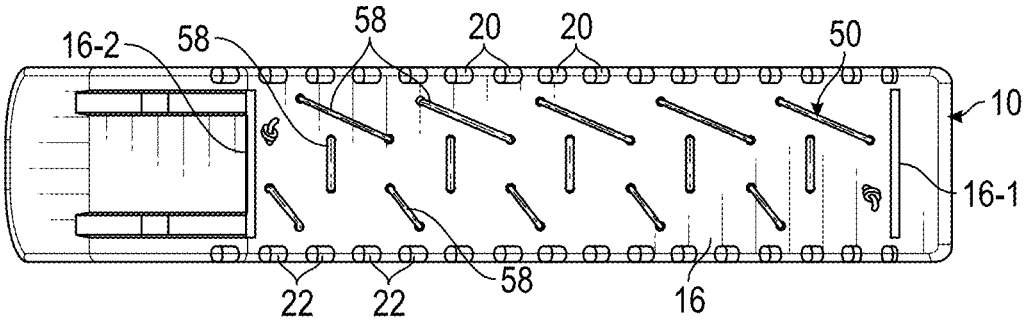
FIG. 6A is a bottom view of a gripping member and an elastic member of the hair accessory of FIG. 5.

In accordance with the disclosed concept, the hair accessory 2 further includes an elastic member 50 (e.g., a cord and/or flexible string-like component) for maintaining the flowers 102 on the hair accessory 2. Specifically, the body 12 of the first gripping member 10 has a first side 14, a second side 16 opposite the first side 14, and a plurality of through holes 17, shown in FIG. 5, extending from the first side 14 to the second side 16. Moreover, the elastic member 50 is preferably woven among the through holes 17 (e.g., in and out) and configured such that a plurality of associated elastic segments (e.g., elastic segments 52,54,56 shown in FIG. 1A, and elastic segments 58 shown in FIG. 6A) are located on each of the first and second sides 14,16, thereby allowing the flowers 102 to be maintained on the first side 14 by the elastic segments 52,54,56 located on the first side 14. In other words, the elastic segments 52,54,56 are configured to be maintained in a relatively snug engaging manner against the first side 14 of the body 12, such that all the user 200 (FIG. 1C) has to do is apply a stretching force to one of the segments 52,54,56, insert one of flowers 102 between the corresponding elastic segment 52,54,56 and the first side 14, and then allow the corresponding elastic segment 52,54,56 to return to their original position for securing the flower 102 against the first side 14.

Additionally, in one example the elastic member 50 is woven among the through holes 17 in a non-linear manner. As a result of this weave pattern, the flowers 102 are advantageously able to be maintained in a manner corresponding to a traditional Hawaiian style wherein the flowers 102 extend outwardly from a common location at preferably 90-degree angles with respect to each other. See FIG. 1A, for example, wherein each of the first row of the segments 52 is located preferably at about a 90-degree angle with respect to each of the second row of the segments 54. Additionally, in order to further replicate the traditional Hawaiian flower-style arrangement, the third row of the segments 56 is located between the first and second rows of the segments 52,54 and is configured to be located at acute angles with respect to each of the first and second rows of segments 52,54.

Figure 6B:
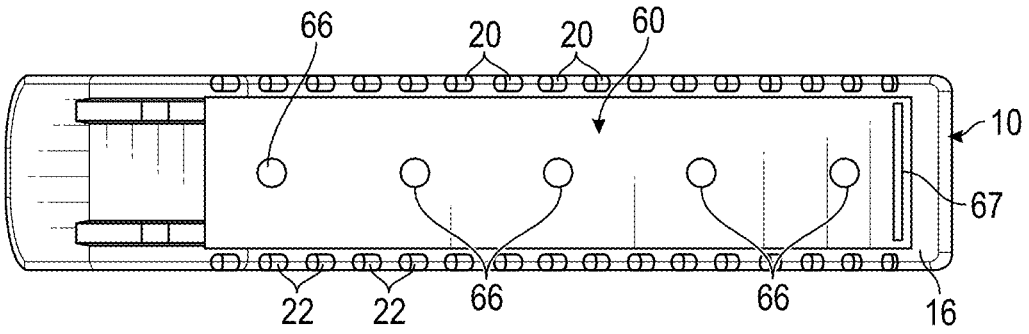
FIG. 6B is a bottom view of the gripping member and elastic member of FIG. 6A, and shown with a cover coupled to a second side of the gripping member.

Referring again to FIG. 5, the hair accessory further has a cover 60 coupled to the second side 16 of the body 12, and the cover 60 is configured to cover the elastic segments 58 located on the second side 16 of the body 12. Compare, for example, FIG. 6A which does not show the cover 60, with FIG. 6B which does show the cover 60. It will be appreciated that the cover 60 covers and prevents access to the elastic segments 58. As a result, the hair accessory 2 is more aesthetically pleasing, and the elastic segments 58 are blocked from undesirable access. For example, as shown in FIG. 6B, the cover 60 is located between a first plurality of the gripping protrusions 20 and a second plurality of the gripping protrusions 22. In this manner, the cover 60 and the second side 16 of the body 12 together encapsulate the elastic segments 58 that are located on the second side 16.

Continuing to refer to FIG. 5, the body 12 preferably has a first radius of curvature, and the cover 60 preferably has a second radius of curvature substantially the same as the first radius of curvature. Additionally, the cover 60 preferably has a main cover portion 62 and a plurality of walls 64-1,64-2 extending upwardly from a perimeter of the main cover portion 62 (e.g., optionally at about 90-degree angles with respect thereto). In one example, the cover 60 is coupled to the second side 16 via an adhesive mechanism (e.g., between the walls 64 and the second side 16) and/or via coupling members (not shown). Accordingly, it will be appreciated that the walls 64 advantageously provide a depth into which the elastic segments 58 can protrude.

Furthermore, the cover portion 62 preferably has at least one through hole 66,67 in order to provide a drainage mechanism for the flowers 102 (FIGS. 1B and 1C) maintained on the first side 14 of the body 12. In one example, the through holes 66 are evenly spaced from each other in order to allow for optimal drainage. Moreover, the through hole 67, as shown in FIGS. 5 and 6B, is elongated and extends from one of the walls 64-1 to another, opposing one of the walls 64-1 in order to allow a majority of moisture from the flowers 102 to drain therethrough when the hair accessory 2 is in an upright position.

Additionally, the cover 60 is advantageously configured to also be coupled to the second side 16 of the gripping member 10 via a snap-fit mechanism, in addition to optionally being coupled via adhesives or coupling members (not shown). For example, as shown in FIG. 5, the second walls 64-2 of the cover 60 have corresponding distal extension portions 64-2-1 which are configured to snap onto indented portions 16-1,16-2 (FIG. 6A) of the second side 16 of the gripping member 10. In this manner, the cover 60 is reliably configured to be maintained on the second side 16 by a plurality of different mechanisms (e.g., snap-fit in addition to either adhesives or coupling members (not shown)).

Figure 7:
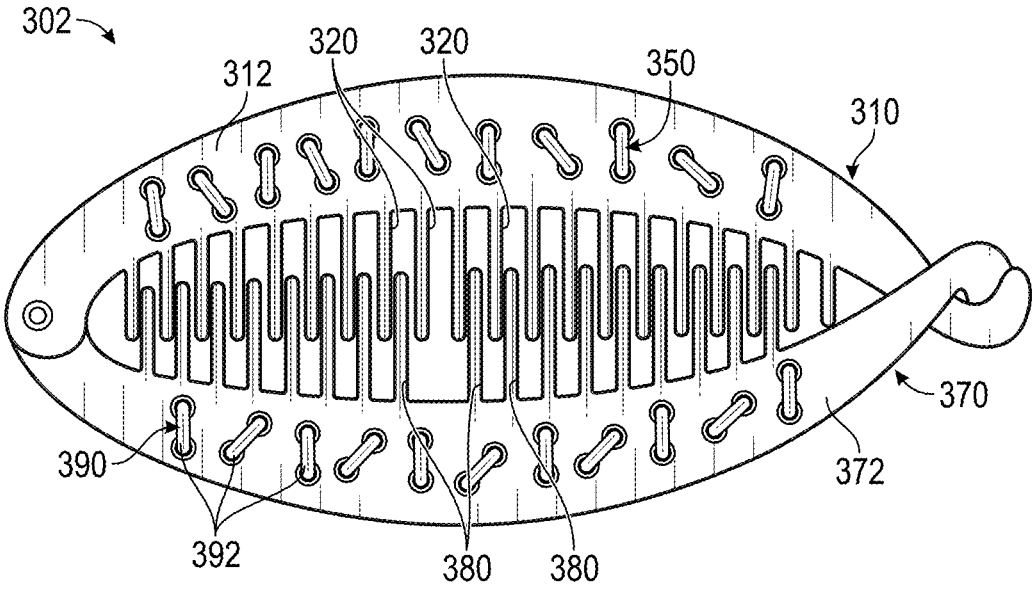
FIG. 7 is a front view of another hair accessory, shown with opposing gripping protrusions located parallel to one another in a closed position, in accordance with another non-limiting embodiment of the disclosed concept.

Although the disclosed concept has been described thus far in association with the hair accessory 2, it will be appreciated that suitable alternative hair accessories can similarly employ elastic members for maintaining flowers on the head of a user, without departing from the scope of the disclosed concept. FIGS. 7-8B show such alternative accessories 302,402, wherein like numbers represent like features.

Referring to FIG. 7, the first and second gripping members 310,370 each include corresponding bodies 312,372 and corresponding gripping protrusions 320,380 extending outwardly therefrom. Furthermore, when the hair accessory 302 is in a closed position, the gripping protrusions 320 of the first gripping member 310 and the gripping protrusions 380 of the second gripping member 370 are located parallel to one another in order to grip hair of a user therebetween. Moreover, in addition to the elastic member 350 extending through the body 312 of the first gripping member 310, the hair accessory 302 further includes a second elastic member 390 extending through the body 372 of the second gripping member 370 in order to provide elastic segments 392 on a first side of the second gripping member 370. As shown the first and second elastic members 350,390 are woven in non-linear manners, in order to allow a user to wear hair ornaments such as flowers in a traditional Hawaiian style. It will also be appreciated that the hair accessory 302 preferably also includes at least one cover (not shown for ease of illustration) configured similar to the cover 60 of the hair accessory 2, discussed above.

Figure 8A:
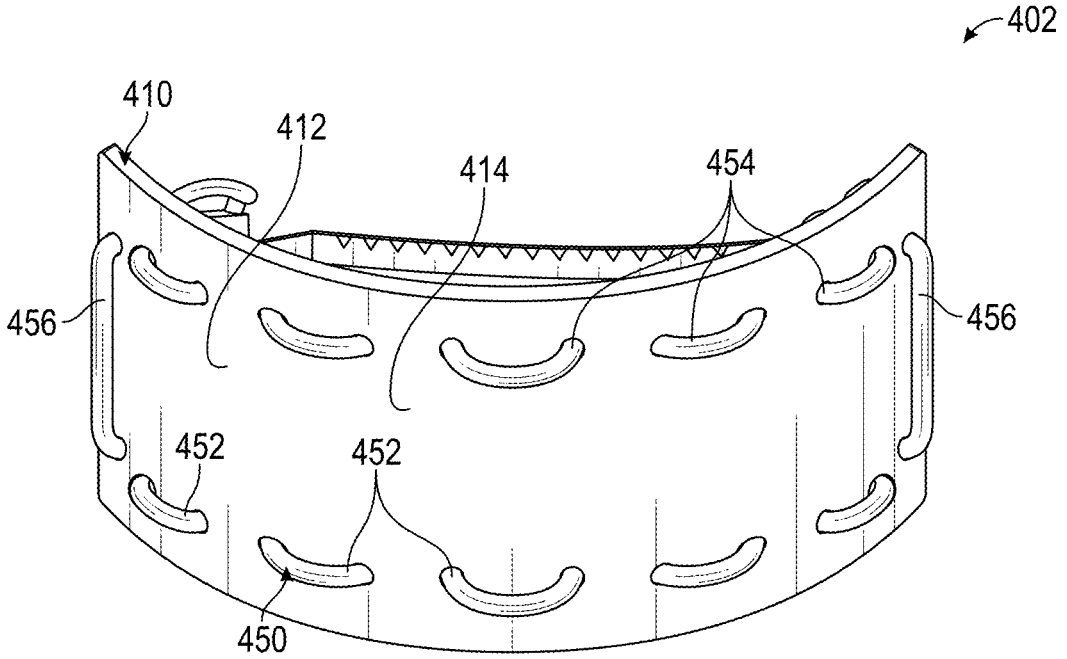
FIGS. 8A and 8B are front isometric and side views, respectively, of another hair accessory, in accordance with another non-limiting embodiment of the disclosed concept.
Figure 8B:
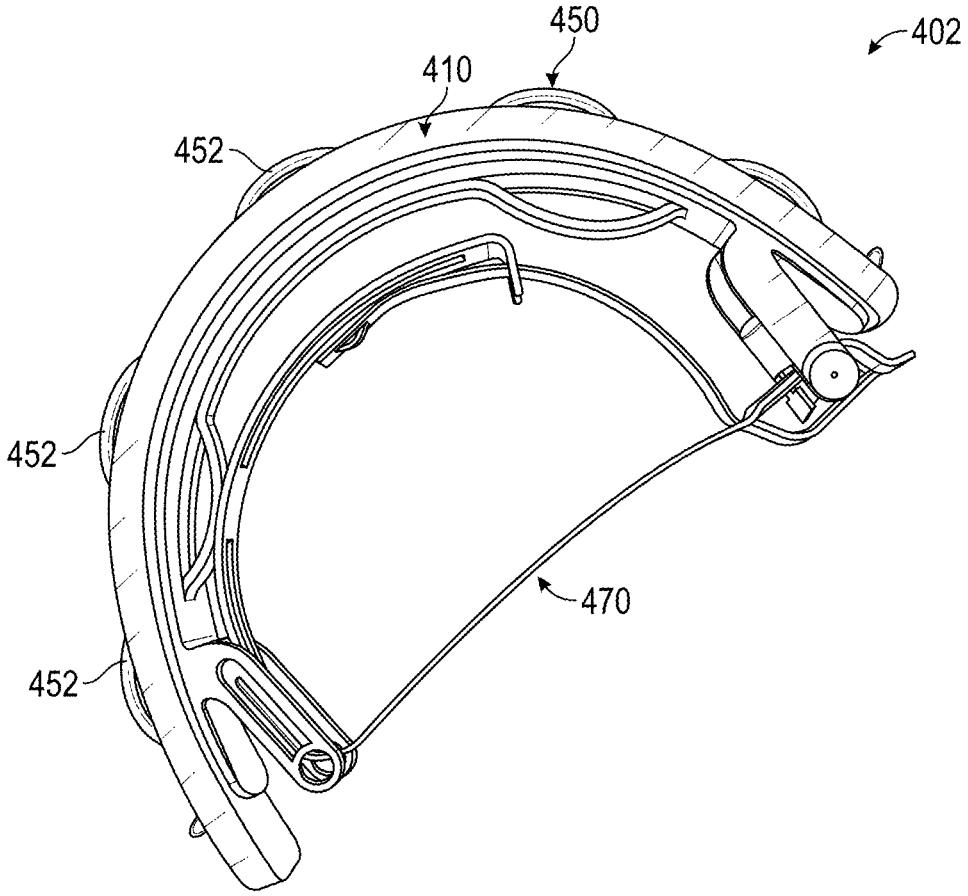

Regarding the hair accessory 402 depicted in FIGS. 8A and 8B, this hair accessory 402 is configured similar to the hair accessories 2,302, depicted above, but is configured in the form of a ponytail clip. Specifically, the hair accessory 402 includes a half-circle shaped gripping member 410, which is configured to maintain hair of a user, as well as a clip apparatus 470 (e.g., shown more clearly in FIG. 8B) coupled to the gripping member 410. Together, these components are configured to maintain hair of a user, such as via a ponytail extending through the gripping member 410 and the clip apparatus 470. Additionally, in the example of FIGS. 8A and 8B, the cover of the hair accessory 402 is preferably in the form of the clip apparatus 470, although it will be appreciated that a similar alternative hair accessory may have a cover located between a clip apparatus and the gripping member 410, without departing from the scope of the disclosed concept.

Continuing to refer to FIGS. 8A and 8B, the gripping member 410 is similar to the gripping member 10, discussed above (e.g., has a body 412 with first and second, opposing sides, and through holes extending from the first to the second side). Additionally, in one example the hair accessory 402 further includes an elastic member 450 woven among the through holes and configured such that elastic segments 452,454,456 are located on the first and second sides of the body 412, thereby allowing flowers and/or other ornaments to be maintained on the first side of the body 412 by the elastic segments 452,454. In one example, the first row of elastic segments 452 and the second row of elastic segments 454 are located parallel to one another (e.g., they are both woven in linear manners), and are connected by other elastic segments 456 which may be perpendicular to the first and second rows of elastic segments 452,454.

Accordingly, it will be appreciated that the disclosed concept provides for an improved (e.g., without limitation, better able to maintain ornaments 102 on the head of a user 200) hair accessory 2,302,402 in which elastic members 50,350,390,450 are woven among through holes 17 of gripping members 10,310,370,410, thereby allowing the ornaments 102 to be maintained on a first side 14 of the gripping members 10,310,370,410. The disclosed concept advantageously allows large numbers of ornaments 102 to be maintained on the head of the user 200 with one single hair accessory 2,302,402, and in exemplary embodiments, in styles that mimic native Hawaiian patterns, such as wherein the ornaments 102 extend at certain angles away from each other.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular implementations. Functionality can be separated or combined in blocks differently in various implementations of the disclosure or described with different terminology. These and other variations, modifications, additions, and improvements can fall within the scope of the disclosure as defined in the claims that follow.

What is claimed is:

1. A hair accessory for use with a plurality of hair ornaments, the hair accessory comprising:

a gripping member configured to grip hair of a user, the gripping member comprising a body and a plurality of gripping protrusions each extending outwardly from the body in order to grip the hair of the user, the body having a first side, a second side opposite the first side, and a plurality of through holes extending from the first side to the second side;

an elastic member woven among the plurality of through holes and configured such that a plurality of associated elastic segments are disposed on each of the first and second sides of the body, thereby allowing a plurality of hair ornaments to be maintained on the first side of the body by the plurality of associated elastic segments disposed on the first side of the body;

a cover coupled to the second side of the body and configured to cover the plurality of associated elastic segments disposed on the second side of the body;

wherein the cover has at least one through hole in order to provide a drainage mechanism for the plurality of hair ornaments maintained on the first side of the body; and wherein the cover comprises a main cover portion and a plurality of walls each extending from the main cover portion, and wherein the at least one through hole includes an elongated through hole extending from a first wall of the plurality of walls to a second, opposing wall of the plurality of walls in order to allow moisture from the plurality of hair ornaments to drain therethrough when the hair accessory is in an upright position.

2. The hair accessory according to claim 1, wherein the cover comprises a main cover portion and a plurality of walls each extending from the main cover portion, and wherein at least one of the walls has a distal extension portion configured to snap into an indented portion of the second side of the gripping member in order to couple the cover to the gripping member.

3. The hair accessory according to claim 1, wherein the cover and the second side of the body together encapsulate the plurality of associated elastic segments disposed on the second side of the body.

4. The hair accessory according to claim 1, wherein the body of the gripping member has a first radius of curvature, and wherein the cover has a second radius of curvature substantially the same as the first radius of curvature.

5. The hair accessory according to claim 1, wherein the plurality of gripping protrusions comprises a first plurality of gripping protrusions and a second plurality of gripping protrusions, and wherein the cover is disposed between the first plurality of gripping protrusions and the second plurality of gripping protrusions.

6. The hair accessory according to claim 1, wherein the elastic member is woven among the plurality of through holes in a non-linear manner.

7. The hair accessory according to claim 6, wherein the plurality of associated elastic segments disposed on the first side comprises first and second rows of segments, and wherein at least one of the first row of segments is disposed at about a 90-degree angle with respect to at least one of the second row of segments.

8. The hair accessory according to claim 7, wherein the plurality of associated elastic segments disposed on the first side further comprises a third row of segments disposed between the first and second rows of segments.

9. The hair accessory according to claim 1, wherein the gripping member is a first gripping member, wherein the hair accessory further comprises a second gripping member coupled to the first gripping member and configured to grip the hair of the user, and wherein the first and second gripping members are configured to open and close with respect to each other in order to allow at least some of the hair of the user to be gripped therebetween.

10. The hair accessory according to claim 9, further comprising a biasing member coupled to each of the first and second gripping members in order to allow the first and second gripping members to be biased toward a closed position.

11. The hair accessory according to claim 10, wherein the second gripping member comprises a body and a plurality of gripping protrusions extending outwardly from the body of the second gripping member, and wherein the plurality of gripping protrusions of the second gripping member extend transverse with respect to the plurality of gripping protrusions of the first gripping member in order that the hair of the user can be gripped in two different orientations.

12. The hair accessory according to claim 10, wherein the elastic member is woven among the plurality of through holes in a non-linear manner.

13. The hair accessory according to claim 9, wherein the second gripping member comprises a body and a plurality of gripping protrusions extending outwardly from the body of the second gripping member, and wherein, when the hair accessory is in a closed position, the plurality of gripping protrusions of the first gripping member and the plurality of gripping protrusions of the second gripping member are disposed parallel to one another.

14. The hair accessory according to claim 13, wherein the elastic member is a first elastic member, wherein the hair accessory further comprises a second elastic member woven among a plurality of through holes of the second gripping member and configured such that a plurality of associated elastic segments are disposed on each of first and second sides of the second gripping member, and wherein at least one of the first and second elastic members is woven in a non-linear manner.

15. A hair accessory for use with a plurality of hair ornaments, the hair accessory comprising:

a gripping member configured to maintain hair of a user, the gripping member comprising a body having a first side, a second side opposite the first side, and a plurality of through holes extending from the first side to the second side;

an elastic member woven among the plurality of through holes and configured such that a plurality of associated elastic segments are disposed on each of the first and second sides of the body, thereby allowing a plurality of hair ornaments to be maintained on the first side of the body by the plurality of elastic segments disposed on the first side of the body; and a curved cover coupled to the second side of the body and configured to cover the plurality of associated elastic segments disposed on the second side of the body, wherein the cover is in a form of a clip apparatus coupled to the gripping member, and wherein the hair accessory is a ponytail clip.

16. The hair accessory according to claim 15, wherein the plurality of associated elastic segments disposed on the first side comprises a first row of elastic segments, a second row of elastic segments disposed parallel to the first row of elastic segments, and at least one other elastic segment connecting the first and second rows of elastic segments.

* * * * *